US005168123A

United States Patent [19]

Lee

[11] Patent Number: 5,168,123

[45] Date of Patent: Dec. 1, 1992

[54] CHEMICAL INITIATION OF DETONATION IN FUEL-AIR EXPLOSIVE CLOUDS

[75] Inventor: John H. Lee, Montreal, Canada

[73] Assignee: Her Majesty the Queen in right of Canada, as represented by the Minister of National Defence of Her Majesty's Canadian Government, Ottawa, Canada

[21] Appl. No.: 553,811

[22] Filed: Jul. 19, 1990

[30] Foreign Application Priority Data

Jul. 20, 1989 [GB] United Kingdom ..... 8916604

[51] Int. Cl.[5] ..... F42B 12/46

[52] U.S. Cl. ..... 102/363; 102/365; 102/367; 102/477

[58] Field of Search ..... 102/334, 363, 365, 367-370, 102/403, 477, 478, 505, 530, 531; 89/1, 13

[56] References Cited

U.S. PATENT DOCUMENTS

| | | | |
|---|---|---|---|
| 1,819,106 | 8/1931 | McBride et al. | 102/365 |
| 2,096,698 | 10/1937 | Lowy et al. | 102/370 |
| 3,724,319 | 4/1973 | Zabelka et al. | 102/363 |
| 4,074,628 | 2/1978 | Manning et al. | 102/363 |
| 4,358,998 | 11/1982 | Schneiter et al. | 102/530 |
| 4,463,680 | 8/1984 | Sayles | 102/363 |
| 4,493,262 | 1/1985 | Hutcheson | 102/363 |
| 4,967,636 | 11/1990 | Murray et al. | 89/1.13 |

FOREIGN PATENT DOCUMENTS

| | | |
|---|---|---|
| 0232194 | 8/1987 | European Pat. Off. . |
| 2014848 | 7/1969 | France . |
| 2226064 | 10/1974 | France . |
| 387494 | 3/1965 | Switzerland . |
| 2199289 | 7/1988 | United Kingdom . |

OTHER PUBLICATIONS

Knystautas, R., Lee, J. H., Moen, I. O. and Wagner, H. Gg. (1970), Direct initiation of spherical detonation by a hot turbulent gas jet, *Proceedings of the Seventeenth Symposium (International) on Combustion*, p. 1235, The Combustion Institute.

Lee, J. H., Knystautas, R. and Yoshikawa, N. (1978), Photochemical initiation of gaseous detonations, *Acta Astronautica* 5, 971.

Lee, J. H. and Moen, I. O. (1979), Fundamental mechanisms of unconfined detonation, *Abstracts from the 1978 AFOSR contractors meeting on unconfined detonations and other explosion related research*, Atlantic Research Corporation Report AFOSR-TR-78-1426.

Mackay, D. J., Murray, S. B., Moen, I. O. and Thibault, P. (1988), Flame-jet ignition of large fuel-air clouds, *Proceedings of the Twenty-Second Syposium (international of Combustion)*.

(List continued on next page.)

*Primary Examiner*—Harold J. Tudor
*Attorney, Agent, or Firm*—Nixon & Vanderhye

[57] ABSTRACT

The invention relates to the chemical initiation of detonation of a fuel-in-air (FAE) cloud such as might be used in a minefield breaching system. A component of the system is adapted to carry fuel to the breaching site and is also adapted to carry a compatible chemical, either gaseous or liquid. Upon detonation of a suitable explosive within the component the fuel is dispersed outwardly to form the cloud and the chemical is jetted outwardly into the cloud in a turbulent manner. A chemical reaction between the chemical initiator and the fuel-air mixture leads almost instantaneously to an explosive shock wave that propagates through the cloud causing detonation thereof. Such detonation neutralizes the minefield along a desired path. With the invention it is not necessary to utilize secondary charges and hence a more efficient and reliable breaching system is achieved.

13 Claims, 4 Drawing Sheets

OTHER PUBLICATIONS

Moen, I. O., Bjerketvedt, D., Engebretson, T., Jenssen, A., Hjertager, B. H. and Bakke, J. R. (1988), Transition to detonation in a flame jet, *Combustion and Flame* 75, pp. 297–308.

Ungut, A. and Shuff, P. J. (1989), Deflagration to detonation transition from a venting pipe, *Combustion Science and Technology.*

Urtiew, P. A., Lee, E. L. and Walker, F. E. (1977), *Chemical initiation of gaseous detonation in a small spherical volume,* Lawrence Livermore Laboratory Report UCRL–79271, Jun. 15, 1977.

von Elbe, G. and McHale, E. T. (1978), Chemical initiation of Fae clouds, *Abstracts from the 1978 AFOSR contractors meeting on unconfined detonations and other explosion related research.* Atlantic Research Corporation Report AFOSR–TR–78–1426.

Zeldovich, Y. B., Librovich, V. B., Makhviladze, G. M. and Sivashinsky, G. I. (1970), On the development of detonation in non–uniformly preheated gas, *Astronautica Acta* 15, 313.

CHEMICAL INITIATION OF DETONATION IN FUEL-AIR EXPLOSIVE CLOUDS

This invention relates to the chemically initiated detonation of fuel-air explosive (FAE) clouds, such as might be employed in a minefield breaching system.

BACKGROUND

During the past several years, Canada has been developing a minefield breaching system based on the concept of fuel-air explosives (FAE). The system has been named "Fuel-Air Line-Charge Ordnance Neutralizer", or FALCON, for which Canadian, United States and European patent applications have been filed. The phenomenon of FAE is a very attractive option for weapons in that a fuel-air cloud covers a large area and produces a strong blast wave. Once detonated, one kilogram of dispersed fuel can generate a blast wave equivalent to that produced by more than five kilograms of TNT.

A conventional FAE event consists of two stages. In the first stage, the fuel is explosively disseminated to form a large fuel-air cloud. Subsequently, in stage two, a high-explosive secondary charge is detonated to generate a shock wave which, in turn, initiates detonation of the dispersed medium.

Examples of the conventional FAE system are found in the above-referenced FALCON patent applications (e.g., U.S. application Ser. No. 389,747 filed on Aug. 4, 1989, now U.S. Pat. No. 4,967,636) and in U.S. Pat. No. 3,724,319; French Patents 2,014,848 and 2,226,064; British 2,199,289 A; Swiss 387,494; and E.P.O. published application 0,232,194.

Typically, a conventional minefield breaching system involves the provision of elongated fuel-carrying means, such as a flexible hose or a plurality of interconnected canisters, that can be laid on a minefield without disturbing the mines. A small rocket, for example, can tow the fuel-carrying means across the minefield with the fuel-carrying means descending by parachute as the rocket comes to earth. Thereafter the fuel is dispersed by the burster charge to create the cloud of fuel droplets-in-air (stage 1) and then a secondary charge is detonated to effect detonation of the dispersed cloud (stage 2). The extremely high pressures created upon cloud detonation will neutralize the mines along the path of the cloud, either by causing them to explode or by rendering them useless, so that men and materiel can cross the minefield along the cleared path.

In the interests of increasing the reliability of FAE devices, while at the same time reducing their size, weight, cost and engineering complexity, a significant effort has been directed toward the development of a "Single-Event" FAE device; that is, one which disperses the fuel into a large cloud that detonates automatically after a prescribed delay time. There is much incentive to eliminate the secondary charges from FAE munitions because these charges are often ejected into the developing fuel-air cloud as the munition approaches the target at high speed. Many weapon system failures have been attributed to the charges being ejected outside the cloud, or detonating in regions of overly rich or lean fuel-air mixture.

If the high-explosive secondary charges, which constitute a strong initiation source, are eliminated from a FAE device, then one must rely on weak ignition (e.g., a mild flame) followed by some method of amplifying a weak compression wave to a shock wave of detonation proportions. Although this phenomenon has been observed experimentally, it is not well understood. In conventional blast initiation of detonation, free radicals for the oxidation processes are brought about by thermal dissociation in the wake of a strong shock wave generated by a powerful energy source. Successful initiation depends on both the shock strength and duration, with the minimum values of these parameters depending on the sensitivity of the combustible mixture. If the initiation source is too weak, chemical reactions can still take place. However, auto-ignition of the mixture may occur too late for the liberated energy to be of use in supporting the leading shock. If detonation is to occur under such circumstances, some means of shock wave amplification, leading to transition from deflagration to detonation (DDT), must come into play.

An important clue in identifying the critical conditions for the onset of detonation can be drawn from observations about initiation in the wake of a reflected shock wave from the end wall of a tube. In this scenario, the fluid particles are heated initially by the incident wave and heated further by the reflected wave. After an induction time, the particles ignite. Although the induction time is the same for all particles in the wake of the reflected wave, ignition occurs in a definite time sequence. The lamina of gas immediately adjacent to the end wall, having been processed first, will be the first to explode. The resulting weak shock wave propagates into the neighboring lamina which, having been processed slightly later in time, will itself be on the verge of exploding. The resulting higher-strength shock wave generated by this second explosion propagates into yet a third lamina where the process is repeated. Although it is not clear whether the shock entering a given lamina actually triggers the explosion or simply arrives there at the precise moment the explosion takes place, it is nonetheless this continuous time sequence of energy release that provides the mechanism for shock wave amplification. In order for amplification to occur, the sequence must be such that the chemical energy release at time t makes an effective contribution to the shock wave produced by the energy release at times less than t. Thus, the phenomenon is one of "shock wave amplification by coherent energy release", or SWACER (Lee et al., 1978). This concept suggests that, given a certain amount of available chemical energy, the optimal means of generating a strong shock wave is not to release it instantaneously and uniformly over a region.

Various means of arranging the appropriate temporal and spatial energy release sequence have been examined. Zeldovich and colleagues (1970) carried out a numerical study of detonation in non-uniformly preheated gas mixtures. For the case of a mild temperature gradient, the pressure rise in the test volume was uniform and substantially less than the detonation pressure. In the other extreme of a steep temperature gradient, the shock wave and reaction zone were seen to decouple, leading to a deflagration. Between these two limits, there existed a range of gradients for which the onset of detonation was observed.

The SWACER concept was first proposed as the mechanism responsible for the photo-chemical initiation of $H_2$—$Cl_2$ mixtures (Lee et al., 1978; Yoshikawa, 1980). In this study, the energy release sequence was determined by the gradient in chlorine atom concentration produced by the photo-dissociation of $Cl_2$ by a flashlamp. Owing to the absorption of light by the gas, the Cl concentration decreased in the direction of the light beam, resulting in a sequence of energy release determined by the dependence of induction time on the Cl concentration. For low flashlamp intensities (steep Cl concentration gradients), no detonation was formed while, for very high intensities (leading to uniform irradiation of the volume), the process approached that of constant volume combustion. Between these two extremes, a range of intensities was identified for which detonation was possible.

The experimental observation that rapid turbulent mixing between combustion products and unburned explosive mixture can lead to detonation provides further support for the SWACER mechanism. In a study by Knystautas et al. (1979), such mixing within large turbulent eddies led to both a temperature gradient and a free-radical concentration gradient. For a large enough eddy and an appropriate turbulent mixing time with respect to the chemical kinetic time scales, detonation was seen to result. The same mechanism was likely operative in the recent investigations by Moen et al (1988), Mackay et al. (1988), and Ungut and Shuff (1989). These authors reported transition to detonation near the exit of a tube following entrainment of hot combustion products into the starting ring vortex ahead of the flame.

Experiments carried out by Lee and co-workers (1979) have shown that the conditions for the onset of detonation can also be realized in the turbulent mixing region generated by opposing reactive gas jets; one containing propane and the other containing a fluorine-oxygen mixture. In these experiments, the delay to ignition was observed to depend on the amount of fluorine present. The chemistry of both the $F_2$—$C_3H_8$—$O_2$ and $F_2$—$C_4H_{10}$—$O_2$ systems has been studied in detail by von Elbe (1974). The study reported by Urtiew et al. (1977) was similar except that the time to the onset of detonation was controlled by the use of an inhibitor, rather than a sensitizer. Tetrafluorohydrazine and silane, which normally react in a nearly instantaneous fashion, were employed in these experiments. However, by using a cis-2-butene inhibitor, the reaction was delayed to allow turbulent mixing within a volume exceeding the critical detonable volume for the mixture. Ignition was seen to occur in a localized region of inhibitor deficiency, followed by shock wave amplification through the region of induction-time gradient.

All of the above-mentioned studies which have led to initiation of detonation by induced chemical sensitization have involved relatively sensitive fuel-oxidizer systems. Although attempts have been made to initiate less sensitive fuel-air mixtures (e.g., Tulis, 1978; von Elbe and McHale, 1979; Sayles, 1984), there is little evidence to suggest that self-sustained detonation has actually been achieved, albeit significant overpressures have been measured.

SUMMARY OF THE INVENTION

The present invention goes beyond what has been previously achieved and achieves the heretofore unreported self-sustained detonation of a fuel-in-air cloud. Specifically the present invention involves the turbulent jetting of a compatible chemical initiator, such as fluorine gas, into a dispersed cloud of fuel, such as hydrogen, creating thereby a chemical reaction that results in self-sustained detonation of the fuel cloud. Many other fuel and initiator combinations are contemplated by the present invention.

The present invention is effective inasmuch as weak ignition escalates to detonation through the phenomenon of shock wave amplification. The entrainment of the compatible chemical within the turbulent jet is responsible for ignition following an induction delay determined by the chemistry of the initiator-fuel system. Also the initiator likely contributes to the establishment of the spatial induction-time gradient required for SWACER to take place. Specifically, it would be possible for a weak shock wave to accelerate in a direction of decreasing initiator concentration. Other purely gasdynamic factors could also play a role. For example, the temperature field within the various shock and vortex elements constituting the initiator jet would have a strong influence on the induction-time gradient. Provided the scale of the turbulent structure is large enough and that sufficient amplification takes a shock wave breaks out of the initiator-sensitized regions.

A practical form of the present invention could be utilized in a minefield breaching system such as the FALCON system (see, U.S. Pat. No. 4,967,636) or such as is shown in U.S. Pat. No. 3,724,319. The improved system would involve an explosive component which carries the appropriate fuel and separated therefrom, a compatible chemical initiator. The component would also carry an explosive charge used to rupture the component and thereby disperse the fuel into the surrounding air. Mere milliseconds (or less) later the initiator would be turbulently jetted into the cloud to effect the chemical reaction that leads to shock wave amplification and total detonation of the cloud. The invention provides components which are particularly effective with gaseous initiators and other components which are particularly effective with liquid initiators.

Thus, the present invention may be considered as providing a container component for use in a fuel-air explosives (FAE) system, the component comprising: a) container means having a rupturable outer wall and adapted to contain a gaseous or a liquid fuel; b) non-rupturable inner containment means within the container means and adapted to contain chemical initiator means compatible with the fuel, and separated from the fuel; c) a plurality of explosively rupturable diaphragm members respectively sealing a plurality of openings through the inner containment means, d) explosive sheet means generally covering the inner containment means; and e) means for detonating the explosive sheet means and for explosively rupturing the diaphragm members.

Furthermore, the invention is seen to provide a container component for use in a fuel-air explosives (FAE) minefield breaching system, the component comprising: a) container means having a rupturable outer wall and adapted to contain a gaseous or a liquid fuel; b) rupturable inner containment means within the container means and adapted to contain chemical initiator means compatible with the fuel; c) explosive means within the inner containment means; d) means for detonating the explosive means; and e) turbulence inducing means generally surrounding the inner containment means.

DESCRIPTION OF THE PREFERRED EMBODIMENT

Figure 1:
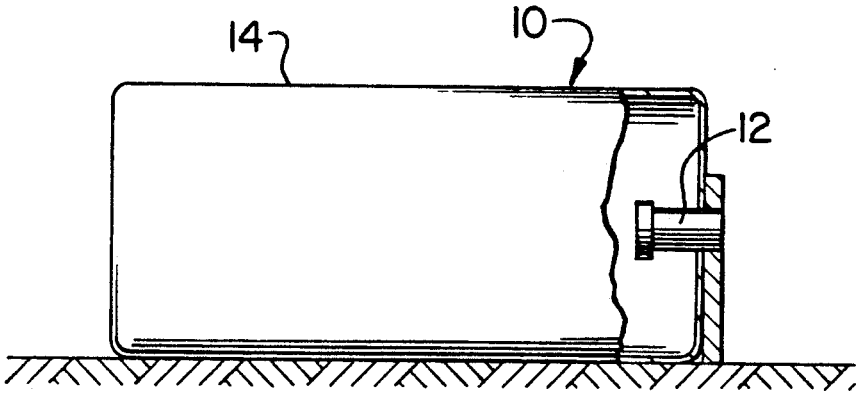
FIG. 1 shows schematically an experimental apparatus used in developing the present invention.
Figure 2:
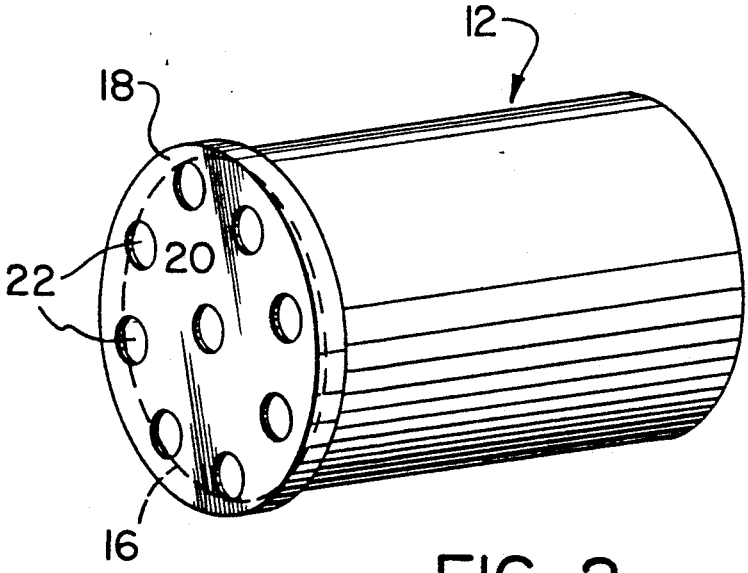
FIG. 2 shows the injection chamber of the experimental apparatus.

The principles of the present invention have been verified using experimental apparatus as illustrated in FIGS. 1 and 2. As shown in FIG. 1, the experimental configuration 10 consisted of a high-pressure injection chamber 12 connected to a large cylindrical plastic bag 14. The chamber, measuring 150 mm in diameter and 300 mm in length, was capped at one end by a thin (0.43 mm thick) brass diaphragm 16. A fluorine-air mixture was prepared in the chamber by the method of partial pressures, with a resultant overpressure of between 1.38 and 1.96 MPa (i.e., $14.8 \leqq \Delta P/P_o \leqq 21.0$). Rapid venting of this mixture was achieved by piercing the diaphragm with a four-ribbed arrowhead driven pneumatically along the internal axis of the chamber. Small-scale turbulence in the venting gases was promoted by a grid plate 18 installed in the exit plane of the chamber. The plate contained a central circular hole 20 of 38 mm diameter surrounded by a series of eight such holes 22 spaced azimuthally apart by 45 degrees. This design provided a venting area equal to 58% of the chamber cross-sectional area.

Initial experiments were conducted in plastic bags of 0.90 m nominal diameter. This was increased to approximately 2 m for many of the later tests to ensure that the boundaries were not influencing the outcome. The bag length was typically 4–6 m. In most tests, the hydrogen concentration in the bag was obtained by the method of partial volumes. This was accomplished by first measuring the volume of the bag inflated with air. Following evacuation of the bag, the required volume of hydrogen was introduced using a calibrated rotameter. The bag was subsequently topped up with air and the constituents mixed by a sparkless fan. In a few of the tests, the fuel concentration was determined by infrared (IR) analysis by adding a small quantity of hydrocarbon tracer (~1% $CH_4$ or $C_3H_8$ by volume) to the hydrogen supply.

Two diagnostic techniques were employed. Pressure transducers (Piezo-electronics) were positioned in an axial array along the periphery of the bag to measure pressure histories and wave velocities. In addition, three high-speed cinematographic cameras with 1 kHz timing mark generators were employed. One camera [~5,000 frames per second (fps)] was placed in a protective housing at the end of the bag opposite the high-pressure chamber so that it was looking along the axis of the jet. A second camera [~12,000 fps] was positioned at the side of the bag looking normal to the jet axis. For many of the tests, the third camera [~6,000 fps] was also situated looking normal to the axis, but was focused specifically on the region near the chamber exit. Occasionally, this camera [~12,000 fps] was oriented 30 degrees off axis looking obliquely into the chamber exit.

In a typical experiment the injection chamber was charged ($\Delta P/P_o = 21.0$) with a mixture of 25% $F_2$ and 75% air by volume. Upon piercing, the diaphragm opened in two pieces, achieving a fully open state in about 1 ms. The emerging $F_2$-air jet possessed an elliptical cross-section as a direct result of the diaphragm rupturing in this manner, the diaphragm petals hinging at the clamped boundary and thereby allowing the $F_2$-air mixture to exit the chamber in a relatively clean fashion. About 2.1 ms after initial perforation the first sign of ignition appears, namely a large and intense central fireball. Within about 0.4 ms of the sudden appearance of the fireball a self-sustained detonation wave was observed. Detonation kernels appear to emerge from the fireball in directions aligned with the nearly vertical diaphragm tear, presumably due to the elliptical distribution of fluorine, or to more intense turbulent mixing near the ends of the tear.

The measured velocity of propagation and maximum detonation pressure in the bag were 1963 m/s and 34 bar, respectively for the above-described experiment. The velocity was deduced from the side-on cinematographic record and represents an average between the time detonation is first observed and its time of arrival at the end of the bag. The computed velocity is in excellent agreement with the Chapman-Jouguet (C-J) velocity of 1968 m/s for this mixture. The maximum pressure is approximately twice the C-J value. Since the maximum was measured by a ground-level transducer positioned either 0.4 m or 1.4 m down axis from the chamber exit, it is likely that the wave impacts the transducer face at some angle approaching 90 degrees, resulting in a pressure close to the reflected detonation pressure being measured. The peak pressure decreases with increasing distance from the chamber exit and approaches the C-J pressure at the far end of the bag.

Other experiments have shown that the initiation phenomenon appears to be a function of both the fluorine concentration and the manner in which the diaphragm ruptures. For example, with the experimental apparatus described initiation of detonation in stoichiometric hydrogen-air is possible for $F_2$ concentrations ranging between 20 and 25 percent. Lower or higher $F_2$ concentrations tend to result in deflagration rather than detonation. Reference may be made to Table 1 for a summary of these test results.

In order for weak ignition to escalate to detonation in the above-described tests, some mechanism for shock wave amplification must have been operative. It is postulated that rapid entrainment of fluorine into the turbulent jet structure is responsible for ignition following an induction delay determined by the chemistry of the fluorine-fuel system. As well, the fluorine likely contributes to the establishment of the spatial induction-time gradient required for SWACER to take place. Specifically, it would be possible for a weak shock wave to accelerate in a direction of decreasing $F_2$ concentration. Other purely gasdynamic factors could also play a role. For example, the temperature field within the various shock and vortex elements constituting the jet would have a strong influence on the induction-time gradient. Provided the scale of the turbulent structure is large enough (e.g., on the order of the critical tube diameter for the surrounding fuel-air mixture) and that sufficient amplification takes place to generate a shock of C-J proportions, initiation of detonation in the surrounding hydrogen-air would occur as the shock wave breaks out of the fluorine-sensitized region.

With a consistent diaphragm opening time of just over 1 ms it was observed that the delay to ignition was sensitive to the amount of fluorine in the chamber. For a concentration near 20%, ignition takes place at about the time the diaphragm achieves a "fully open" state. The delay to ignition increases with increasing $F_2$ concentration and reaches a maximum of about 2.1 ms for 25.5% $F_2$. This trend reverses for further increases in fluorine concentration. Although it is not clear why this is so, it would appear that the shock wave amplification mechanism responsible for initiation of detonation along the lower branch of the ignition curve is not present along the upper branch. Since the gasdynamics of the jet vary negligibly over this small range of $F_2$ concentration, failure to initiate must be a consequence of changes in chemistry alone. In view of the fact that the delay to ignition decreases for $F_2$ concentrations above 25.5%, it is likely that an inappropriate induction-time gradient, and not the induction time itself, is responsible for SWACER ceasing to be successful.

Amplification and transition to detonation are quite rapid once ignition occurs. The amplification time ranges from about 0.23 ms near the lower $F_2$ concentration limit to about 0.45 ms at the upper limit. This decrease in chemical kinetic rate with increasing fluorine is consistent with the observations about the ignition delay time. In the absence of detailed information about the velocity profile during amplification, it is only possible to make a crude estimate of the amplification distances. This can be done by assuming that the initial compressive disturbance propagates at sonic velocity in the hydrogen-fluorine-air mixture, and that the resultant velocity of the amplified wave is $\sim V_{C-J}$ for stoichiometric hydrogen-air. This gives a mean velocity of about 0.6 $V_{C-J}$. In conjunction with the times above, the estimated amplification distances are 0.27 m and 0.53 m at the lower and upper $F_2$ concentration limits, respectively. These compare well with the characteristic transverse dimension of the detonation kernels that appear suddenly in the cinematographic sequences and are not much larger than the critical tube diameter of 0.2 m for detonation transmission in stoichiometric $H_2$-air.

In order to elucidate the importance of small-scale turbulence in the jet-initiation phenomenon, a series of tests was conducted in which the grid plate 18 was removed from the exit plane of the chamber. The test results show that initiation was not possible without the plate present. This observation emphasizes that small-scale turbulence is essential for the mixing processes leading to a high rate of energy release and hence the conditions for shock wave amplification. Since the phenomena of interest occur quickly in comparison with the characteristic venting time of the chamber, it cannot be argued that removal of the grid plate altered the gasdynamic time scale sufficiently to cause a mismatch between the essential chemical kinetic and gasdynamic processes. Thus, the failure to initiate must be due to the absence of small-scale turbulence alone. Such turbulence is necessary for the rapid mixing between reactive chemical species. In the absence of such turbulence, chemical reactions could only occur at the interface between large pockets of fuel-air and $F_2$-air during the entrainment processes.

Reference may be made to Table 2 for a summary of these test results.

Successful initiation of detonation in hydrogen-air mixtures near stoichiometric conditions has been achieved by a turbulent fluorine-air jet, as described in detail above. High-speed cinematography and the results of numerical calculations to describe the turbulent jetting process suggest that transition to detonation could be the result of shock wave amplification inside a toroidal vortex generated by the jetting gases. Amplification would appear to be possible over a small time interval during which substantial gradients in both temperature and $F_2$ concentration extend over a sizeable volume. Photographic evidence suggests that the resulting explosion in the torus might not lead to detonation directly, but instead might generate a shock wave which converges on the jet axis, giving rise to a Mach disc which evolves into a spherical detonation wave.

It has also been found that the turbulent jet initiation phenomenon is possible with other chemical kinetic systems. For example, detonation of ethylene-air mixtures has also been achieved using a fluorine jet initiator. As well, fluorine is not the only gaseous initiator possible. Chlorine and the other three halogens should work equally well. Hot combustion products, created by burning hydrogen and oxygen in a closed vessel, have been shown in field experiments to be a successful initiator of detonation for acetylene-air mixtures. These products have a high population of hot free radicals which are capable of establishing the induction-time gradient required for SWACER to occur.

Figure 3:
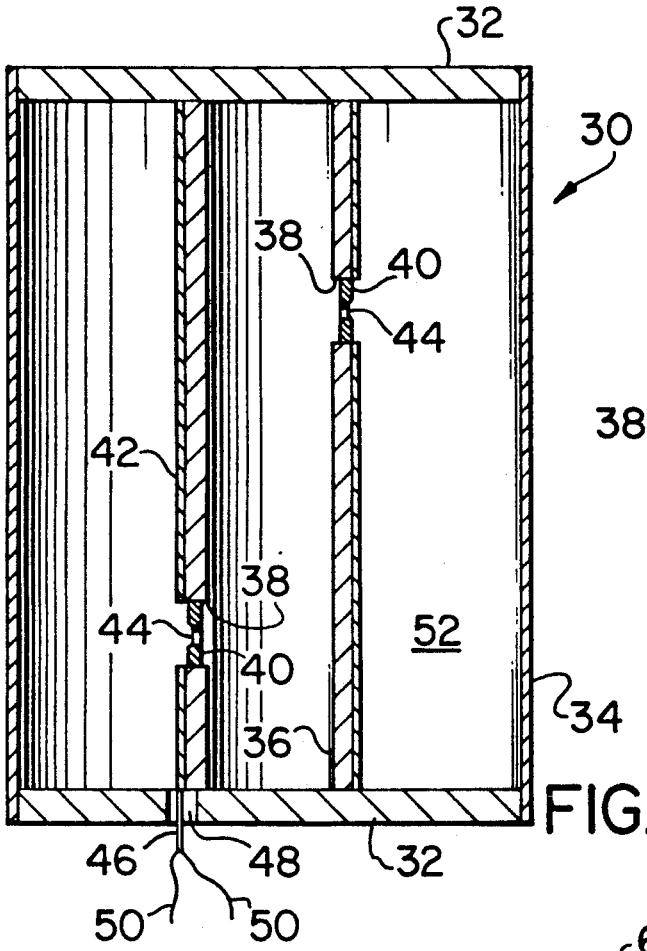
FIG. 3 shows a first practical component, in longitudinal cross-section, for use with a gaseous initiator.
Figure 3A:
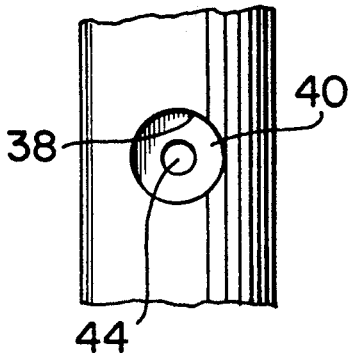
FIG. 3A shows an enlargement of a portion of FIG. 3.
Figure 4:
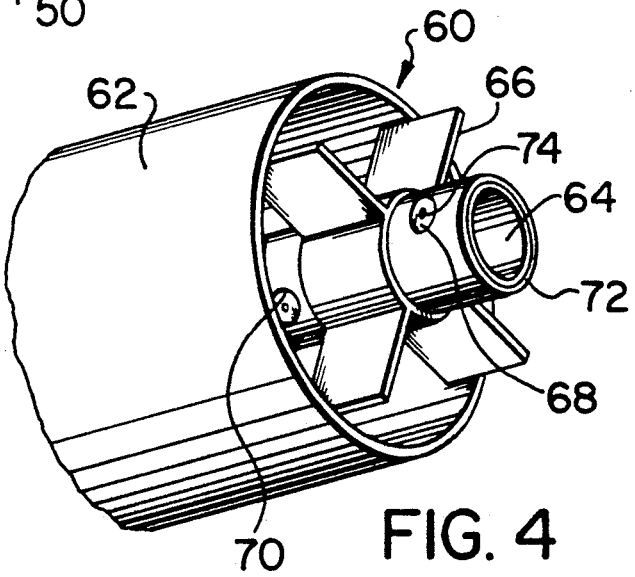
FIG. 4 shows a second practical component, in longitudinal cross-section, for use with a gaseous initiator.
Figure 5:
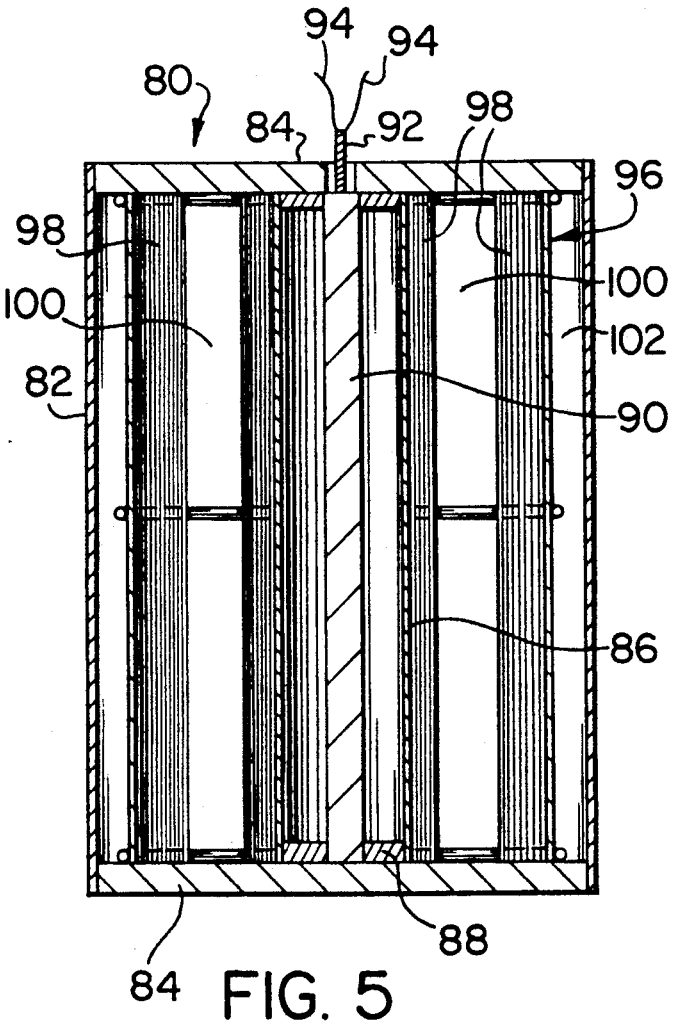
FIG. 5 shows a third practical component, in longitudinal cross-section, for use with a liquid initiator.
Figure 5A:
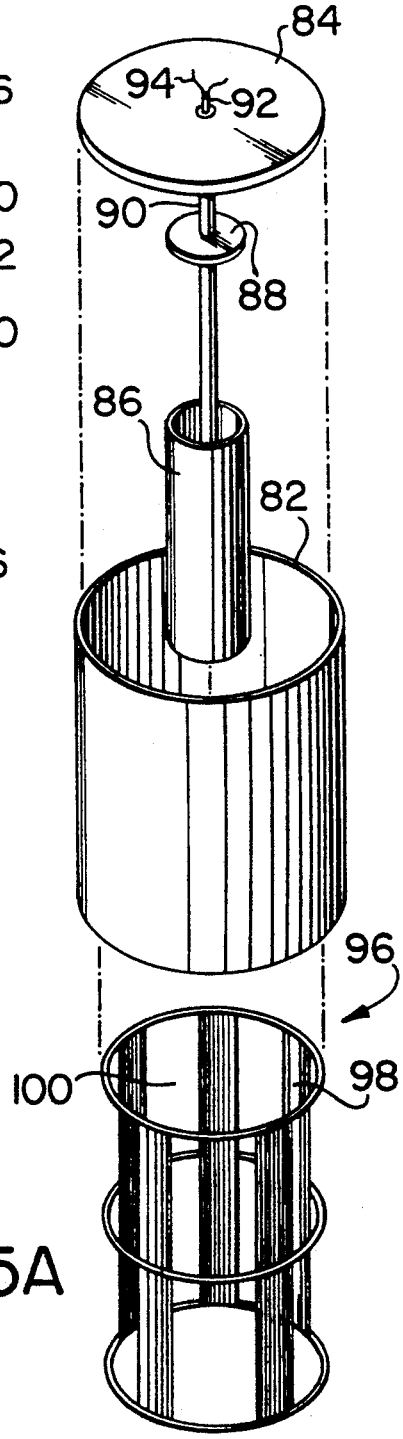
FIG. 5A shows an exploded view of the embodiment of FIG. 5.
Figure 6:
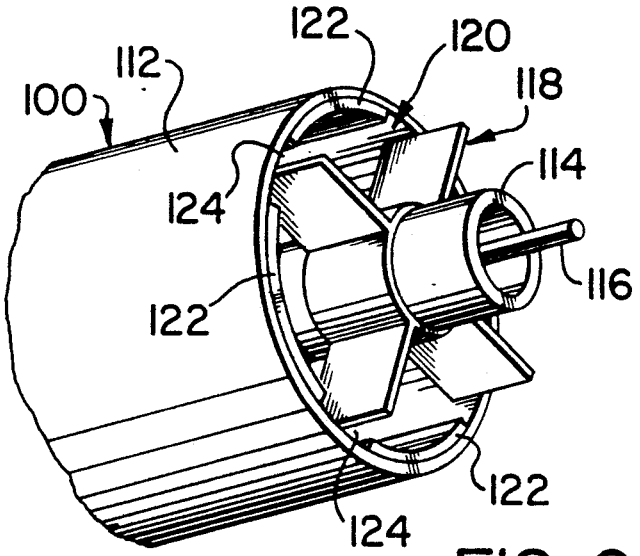
FIG. 6 shows a fourth practical component, in longitudinal cross-section for use with a liquid initiator.

Practical embodiments of the principles developed and expounded hereinabove are illustrated generally in FIGS. 3 to 7. FIGS. 3, 3A and 4 illustrate a gaseous chemically-initiated device based on the phenomena discussed, while FIGS. 5, 5A and 6 illustrate a liquid-only device.

With reference to FIG. 3 a container 30 is illustrated, generally in the configuration of a cylinder having heavy non-rupturable end walls 32 and a rupturable peripheral outer wall 34. An inner containment means such as elongated cylindrical member 36 is provided within the container 30, shown as extending longitudinally thereof between the end walls 32. The member 36 is formed of a heavy non-rupturable material but it is provided along its length and around its periphery with a plurality of through openings 38. Each opening is sealed by a metallic rupturable diaphragm 40.

A thin sheet 42 of high explosive material is wrapped about the inner cylinder 36, generally covering that cylinder, although preferably the diaphragm members 40 are uncovered. A small explosive disc 44 is centrally mounted on each diaphragm member and a detonator 46 is positioned in an opening 48 in an end wall 32 so as to be in contact with the explosive sheet 42. Wires 50 connect the detonator 46 to an appropriate activating device.

Figure 7:
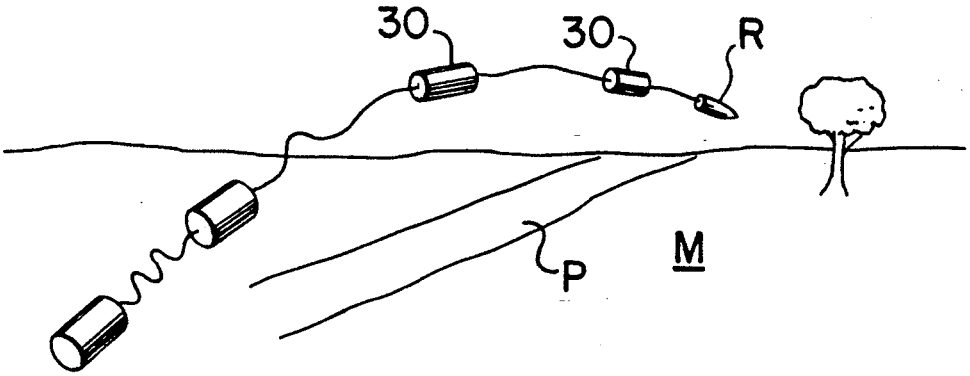
FIG. 7 shows a typical minefield breaching system using components in accordance with the present invention.

The container 30 could be part of a minefield breaching device such as is shown in U.S. Pat. No. 3,724,319 and as seen in FIG. 7 wherein a projectile R tows a plurality of such containers 30, series connected, for deposition on a minefield M along a desired path P. The containers 30 would contain a liquid fuel in the annular cavity 52 and a high pressure fluorine-air mixture in the inner cylinder 36. Once the containers 30 are in place on the minefield the sheet explosive 42 is detonated, as are the explosive discs 44. Detonation of the sheet explosive 42 causes the outer wall 34 to rupture as the fuel is projected radially outwardly to form a fuel droplets-in-air cloud in the usual manner. Detonation of the explosive discs 44 would rupture the diaphragms 42, causing them to accelerate radially inwardly. This would result in a series of reactive turbulent jets of $F_2$-air exiting the inner cylinder 36, the $F_2$-air mixture reacting with the fuel-air cloud and leading to initiation of detonation of the cloud. Detonation of the cloud would, in turn, create overpressures on the minefield along the desired path, effectively neutralizing the mines.

FIG. 4 illustrates a component 60 for a minefield breaching system such as is disclosed in U.S. Pat. No. 4,967,636. In this instance the container is a continuous length 62 of rupturable hose material while the inner containment means is a continuous length 64 of non-rupturable hose material located within the hose 62 and, preferably, centrally located therein by spacers such as wings 66. As with the first embodiment the inner hose 64 has a plurality of rupturable diaphragm members 68 sealing openings 70 distributed along the length, and about the periphery, of the inner hose 64. Flexible sheet explosive material 72 generally covers the inner hose 64 as before, and an explosive disc 74 is located on each diaphragm member.

In a manner analogous to that of the aforementioned application the hoses 62,64 would be towed, in an empty condition, by a suitable projectile so as to overlie the desired path through the minefield. A suitable liquid fuel would be pumped into the cavity between the hoses and a compatible chemical initiator would be pumped under high pressure into the inner hose 64. Thereafter detonation of the explosive charges and of the ensuing fuel droplets-in-air cloud would take place as in the previous embodiment. With this embodiment the cloud would be continuous at the time of its creation, rather than made up of discrete pockets as with the previous embodiment.

FIG. 5 shows a component 80 analogous to that of FIG. 3 but using liquids exclusively. In this embodiment the container 80 has a rupturable outer wall 82 and non-rupturable end walls 84. The inner containment means is a rupturable inner cylinder 86 extending generally axially of the container, the inner cylinder being sealed from the outer cylinder by end caps 88. An explosive burster charge 90 extends axially of the inner cylinder 86 and is connected to a detonator 92 at one end thereof. Wires 94 connect the detonator 92 to a suitable actuator (not shown).

With particular reference to FIG. 5A there is seen a turbulence inducing cage 96 made up of a plurality of circumferentially alternating slats 98 and openings 100. The cage should withstand the explosive detonations involved so that it can induce turbulence in the initiator liquid as described below. Although the cage is shown as being positioned between the inner container 86 and the outer wall 82 it is possible to place the cage on the exterior of the container, surrounding the outer wall 82.

In operation the container 80 would be deployed in the same manner as container 30. In this case however, the chemical initiator compatible with the fuel in cavity 102 is a liquid such as chlorine trifluoride or triethyl aluminum. Detonation of the burster charge will expel the liquid fuel through the ruptured outer wall 82 to create the requisite cloud and will also expel the pyrophoric compatible liquid initiator through the ruptured inner cylinder 86. As the liquid initiator encounters the cage 96 the slats 98 will induce turbulent vortices in the liquid initiator, as well as in the cloud, the interaction of such vortices leading to the reactions necessary to achieve initiation of detonation of the cloud and subsequent breaching of the minefield.

FIG. 6 shows a component 110 analogous to that of FIG. 4. In this case the outer hose 112 has a rupturable outer wall while the rupturable inner hose 114 carries a centrally located burster charge 116 and is centrally located in the hose 112 as by wings 118. The component 110 is delivered to the breaching lane in an empty state and is then pumped full of the compatible liquid fuel and liquid initiator. Detonation follows as in the previous embodiment, the turbulence being created by the flexible turbulence-inducing cage 120 made up of alternating slats 122 and spaces 124.

The foregoing discussion has concentrated on a limited number of fuel and initiator combinations. It is, of course, contemplated that the invention is operable with either liquid or gaseous fuels and with gaseous or liquid initiators. Appropriate liquid fuels would include butane, propylene oxide, propane, hexyl nitrate, ethyl hexyl nitrate, 1-hexene and acetylene dissolved in acetone. All of these fuels are very detonation sensitive when mixed with air. As previously indicated, suitable initiators would include the halogens or hot products of combustion. In a working device using the latter initiator the inner container would be filled with a mixture of a gaseous fuel (e.g. hydrogen) and oxygen instead of fluorine. The mixture would be ignited about 0.25–0.5 seconds prior to fuel dissemination. This approach is attractive because a fuel-oxygen mixture in the unburned state is quite tame in comparison with fluorine. As well, it only becomes pressurized when burned and is therefore safer to use in a FALCON-type system or to store over long periods of time.

For systems using liquid initiators such as might be used in the embodiments of FIGS. 5, 5A and 6 it is contemplated that other organometallic compounds, whether neat or diluted, would perform as well as triethyl aluminum. Other candidates that could be used neat or diluted include trimethylaluminum, trinormalpropylaluminum, trinormalbutylaluminum, trinormalhexylaluminum, trinormaloctylaluminum, diisobutylaluminum hydride, diethylaluminum chloride, diisobutylaluminum chloride, ethylaluminum sesquichloride, isobutylaluminum dichloride, diethylaluminum iodide, and diethylzinc. All of the above compounds are highly reactive liquids at atmospheric conditions.

Finally, for systems using gaseous fuels it is contemplated that acceptable fuels would include acetylene, hydrogen, ethylene, propane and butane. The last two fuels have previously been identified as suitable liquid fuels; that is because they have a vapour pressure that is close to atmospheric pressure.

All embodiments of the present invention do away with the need for separate secondary charges and appropriate timing mechanisms. They are less expensive to manufacture than prior art devices and they should prove to be more reliable and safer to use. Although only four embodiments have been illustrated it is expected that a skilled person in the art would be able to utilize the principles of the present invention in alternative constructs and accordingly the protection to be afforded this invention is to be determined from the claims appended hereto.

REFERENCES

Knystautas, R., Lee, J. H., Moen, I. O. and Wagner, H. Gg. (1970). Direct initiation of spherical detonation by a hot turbulent gas jet. *Proceedings of the Seventeenth Symposium (International) on Combustion*, p. 1235. The Combustion Institute.

Lee, J. H., Knystautas, R. and Yoshikawa, N. (1978), Photochemical initiation of gaseous detonations. *Acta Astronautica* 5, 971.

Lee, J. H. and Moen, I. O. (1979), Fundamental mechanisms of unconfined detonation. *Abstracts from the* 1978 *AFOSR contractors meeting on unconfined detonations and other explosion related research.* Atlantic Research Corporation Report AFOSR-TR-78-1426.

Mackay, D. J., Murray, S. B., Moen, I. O. and Thibault, P. (1988), Flame-jet ignition of large fuel-air clouds. *Proceedings of the Twenty-Second Symposium (International) on Combustion.*

Moen, I. O., Bjerketvedt, D., Engebretson, T., Jenssen, A., Hjertager, B. H. and Bakke, J. R. (1988), Transition to detonation in a flame jet. *Combustion and Flame* 75, pp. 297–308.

Sayles, D. C., (1984), *Method of generating single-event unconfined fuel-air detonation.* U.S. Pat. No. 4,463,680 dated Aug. 7, 1984.

Tulis, A. J. (1978), Induced heterogeneous detonation in hypergolic fuel-oxidizer dispersions. *Presentation at the Eastern Section of the Combustion Institute Fall Technical Meeting*, Miami Beach, Fla., November 1978.

Ungut, A. and Shuff, P. J. (1989), Deflagration to detonation transition from a venting pipe. *Combustion Science and Technology.*

Urtiew, P. A., Lee, E. L. and Walker, F. E. (1977), *Chemical initiation of gaseous detonation in a small spherical volume.* Lawrence Livermore Laboratory Report UCRL-79271, Jun. 15, 1977.

von Elbe, G. and McHale, E. T. (1979), Chemical initiation of fae clouds. *Abstracts from the* 1978 *AFOSR contractors meeting on unconfined detonations and other explosion related research.* Atlantic Research Corporation Report AFOSR-TR-78-1426.

Yoshikawa, N. (1980), *Coherent shock wave amplification in photochemical initiation of detonations.* Ph. D. Thesis, Department of Mechanical Engineering, McGill University, Montreal Canada.

Zeldovich, Ya. B., Librovich, V. B., Makhviladze, G. M. and Sivashinsky, G. I. (1970), On the development of detonation in non-uniformly preheated gas. *Astronautica Acta* 15, 313.

TABLE 1

Turbulent Jet Initiation of Hydrogen-Air Mixtures
Test Employing Turbulence Grid in Exit Plane

| Test No. | Ambient Pressure (mbar) | Ambient Temperature (C.) | Fluorine-Air Chamber $F_2$ (%) | Fluorine-Air Chamber Pressure (MPa) | Fuel-Air Mixture $H_2$ (%) | Fuel-Air Mixture Bag Diameter (m) | Outcome |
|---|---|---|---|---|---|---|---|
| 8418 | 920 | 26 | 20.0 | 1.93 | 30 | 1.88 | Deflagration: Ring of ignition centres formed around periphery of exit. Two explosion nuclei developed adjacent to ends of diaphragm tear but attenuated quickly. Violent explosion observed in bag. |
| 8306 | 920 | 30 | 20.0 | 1.38 | 30 | 0.92 | Detonation: $F_2$-air jetted through small hole in diaphragm (−3 ms) prior to rupture. Two flame kernels developed in diametrically opposed regions well displaced from exit in radial direction. Rapid flame acceleration through precursor jet region led to onset of detonation. $V_{ave}$ = 2032 m/s. No pressure data obtained. |
| 8424 | 931 | 31 | 20.4 | 1.93 | 30 | 2.00 | Detonation: Ring of ignition centres formed around periphery of exit. Two explosion nuclei developed adjacent to ends of diaphragm tear. Lower nucleus attenuated. Detonation evolved from upper nucleus. $V_{ave}$ = 1854 m/s. $P_{max}$ = 26.6 bar. |
| 8420 | 923 | 31 | 23.0 | 1.93 | 30 | 1.96 | Detonation: Ring of ignition centres formed around periphery of exit. Two explosion nuclei developed adjacent to ends of diaphragm tears. Upper nucleus attenuated. Detonation evolved from lower nucleus. $V_{ave}$ = 2176 m/s. $P_{max}$ = 17.2 bar. |
| 8663 | 920 | 14 | 24.1 | 1.96 | 29 | 0.97 | Deflagration: Several ignition centres formed around periphery of exit. Two large intense flame kernels developed near axis downstream of diaphragm. Interaction between kernels led to enhanced burning but failed to bring about onset of detonation. |
| 8765 | 929 | 17 | 24.1 | 1.96 | 29 | 1.94 | Detonation: No cinematographic data obtained. $V_{ave}$ = 2216 m/s. $P_{max}$ = 17.1 bar. |
| 8307 | 923 | 26 | 25.0 | 1.38 | 43 | 1.80 | Detonation: Numerous ignition centres formed across exit plane with diaphragm only half open. Pair of intense flame kernels developed in vicinity of two lower diaphragm flaps. Detonation ensued near instantaneously. $V_{ave}$ = 2077 m/s. $P_{max}$ = 25.3 bar. |
| 8419 | 936 | 25 | 25.0 | 1.93 | 30 | 1.87 | Detonation: Diaphragm opened in two halves resulting in jet of elliptical cross section. Ignition centres did not appear. Large central flame ball formed suddenly following time delay. Detonation emerged from top of flame ball in direction aligned with diaphragm tear. $V_{ave}$ = 1963 m/s. $P_{max}$ = 33.8 bar. |
| 8416 | 921 | 33 | 25.0 | 1.93 | 30 | 1.88 | Detonation: Twist in bag resulted in exit covered by layer of polyethylene prior to diaphragm rupture. Ring of ignition centres formed around 80% of exit periphery. Explosion nucleus developed adjacent to end of diaphragm tear but attenuated. Intense flame kernel appeared in region adjacent to the end of second diaphragm tear. Detonation formed well away from exit (radially) in vicinity aligned with diaphragm flap. |

TABLE 1-continued

Turbulent Jet Initiation of Hydrogen-Air Mixtures
Test Employing Turbulence Grid in Exit Plane

| Test No. | Ambient Pressure (mbar) | Ambient Temperature (C.) | Fluorine-Air Chamber $F_2$ (%) | Fluorine-Air Chamber Pressure (MPa) | Fuel-Air Mixture $H_2$ (%) | Fuel-Air Mixture Bag Diameter (m) | Outcome |
|---|---|---|---|---|---|---|---|
| | | | | | | | $V_{ave}$ = 2135 m/s. $P_{max}$ = 33.8 bar. |
| 8303 | 922 | 30 | 25.0 | 1.38 | 27[1] | 0.90 | Deflagration: Diaphragm opened in two halves yielding jet of elliptical cross section. Ignition centres did not form. Vigorous exothermic reaction occurred well downstream of exit following slight time delay. Combustion phenomena barely visible in cinematographic records. $P_{max}$ = 1.6 bar. |
| 8304 | 924 | 26 | 25.0 | 1.38 | 23[2] | 0.90 | Deflagration: Isolated ignition centres formed around periphery of exit. Vigorous exothermic reaction occurred although minimal evidence of flame propagation visible in cinematographic records. $P_{max}$ = 0.8 bar. |
| 8664 | 919 | 15 | 26.8 | 1.96 | 30 | 0.97 | Deflagration: Ring of ignition centres formed around periphery of exit. Several explosion nuclei evolved and intensified through interaction but failed to result in transition to detonation. Violent explosion observed in bag. |
| 8421 | 931 | 29 | 27.0 | 1.93 | 30 | 1.96 | Detonation: Group of ignition centres formed along small fraction of exit periphery. Sudden formation of large central flame ball generated significant transmitted shock wave. As flame ball attenuated, shock wave reflected from hump in bag to impinge on remnant of jet. This interaction induced transition to detonation. $V_{ave}$ = 1922 m/s. $P_{max}$ = 18.5 bar. |
| 8302 | 922 | 27 | 30.0 | 1.38 | 36[3] | 0.90 | Deflagration: Isolated ignition centres formed around exit periphery but attenuated rapidly. Mild exothermic reaction ensued. Combustion phenomena barely visible in cinematographic records. No pressure data obtained. |
| 8417 | 920 | 21 | 30.0 | 1.93 | 30 | 1.88 | Deflagration: Ring of ignition centres formed around exit periphery with diaphragm only half open. Annular flame kernel initially grew in size while diminishing in luminosity. Subsequently, large annular flame appeared with centres of intense reaction. Explosion nuclei did not develop. Violent burning observed in bag. |
| 8301 | 925 | 20 | 35.0 | 1.38 | 38[4] | 0.90 | Deflagration: Mild exothermic reaction observed. No cinematographic or pressure data obtained. |

[1] $CH_4$ tracer present (1.0% of total mixture).
[2] $C_3H_8$ tracer present (0.83% of total mixture).
[3] $CH_4$ tracer present (1.3% of total mixture).
[4] $CH_4$ tracer present (1.4% of total mixture).

TABLE 2

Turbulent Jet Initiation of Hydrogen-Air Mixtures
Tests Without Turbulence Grid in Exit Plane

| Test No. | Ambient Pressure (mbar) | Ambient Temperature (C.) | Fluorine-Air Chamber $F_2$ (%) | Fluorine-Air Chamber Pressure (MPa) | Fuel-Air Mixture $H_2$ (%) | Fuel-Air Mixture Bag Diameter (m) | Outcome |
|---|---|---|---|---|---|---|---|
| 8771 | 931 | 28 | 12.0 | 1.96 | 32 | 1.94 | No Ignition: Minimal heat release over several seconds evidenced by swelling and wrinkling of bag. No indication of ignition phenomena in cinematographic records. No measurable pressure rise recorded. |
| 8662 | 922 | 8 | 24.0 | 1.96 | 27 | 0.97 | Deflagration: Series of isolated ignition centres formed around periphery of exit but attenuated rapidly. Combustion phenomena barely visible in cinematographic records. Mild exothermic reaction observed in bag. |
| 8661* | 923 | 9 | 24.0 | 1.96 | 30 | 0.97 | Deflagration: Series of isolated ignition centres formed around periphery of exit but attenuated rapidly. Combustion phenomena barely visible in cinematographic records. Mild exothermic reaction observed in bag. |
| 8766 | 927 | 18 | 24.0 | 1.96 | 32 | 1.94 | Deflagration: Diaphragm opened in two halves. Ignition centres first formed in vicinity adjacent to end of diaphragm slit. Subsequently, two arcs of ignition centres developed along periphery of diaphragm opening. These initially grew in size and luminosity but then attenuated. Mild exothermic reaction observed in bag. $P_{max}$ = 1.9 bar. |
| 8764 | 922 | 20 | 24.0 | 1.96 | 33 | 1.94 | Deflagration: Diaphragm opened in two halves. Series of ignition centres in vicinity adjacent to end of diaphragm slit gave rise to intense fire ball. Simultaneously, two arcs of ignition centres developed along periphery of diaphragm opening. Violent burning |

TABLE 2-continued

| Test No. | Ambient Pressure (mbar) | Ambient Temperature (C.) | Turbulent Jet Initiation of Hydrogen-Air Mixtures Tests Without Turbulence Grid in Exit Plane: Fluorine-Air Chamber $F_2$ (%) | Pressure (MPa) | Fuel-Air Mixture $H_2$ (%) | Bag Diameter (m) | Outcome |
|---|---|---|---|---|---|---|---|
| | | | | | | | observed in bag. $P_{max}$ = 3.7 bar. |

*An orifice plate having a hole diameter of 102 mm was installed in the exit plane.

The embodiments of the invention in which an exclusive property or privilege is claimed are defined as follows:

1. A container component for use in a fuel-air explosives (FAE) system, said component comprising:
   a) container having a rupturable outer wall for containing fuel;
   b) non-rupturable inner containment means within said container means for containing a chemical initiator which is compatible with said fuel;
   c) a plurality of explosively rupturable diaphragm members respectively sealing a plurality of openings through said inner containment means;
   d) explosive sheet means generally covering said inner containment means; and
   e) means for detonating said explosive sheet means and for explosively rupturing said diaphragm members.

2. The component of claim 1 wherein said container means comprises an elongated cylinder having non-rupturable end walls and said inner containment means comprises an annular cylinder extending axially of said elongated cylinder between said end walls.

3. The component of claim 2 wherein said openings are distributed along the length and about the periphery of said annular cylinder.

4. The component of claim 3 wherein each of said diaphragm members comprises a metallic diaphragm sealing the opening and carrying an explosive disc centrally thereof.

5. The component of claim 1, wherein the fuel is one selected from liquid and gaseous fuels.

6. A container component for use in a fuel-air explosives (FAE) system, said component comprising:
   a) container means having a rupturable outer wall;
   b) non-rupturable inner containment means within said container means;
   c) a plurality of explosively rupturable diaphragm members respectively sealing a plurality of openings through said inner containment means;
   d) explosive sheet means generally covering said inner containment means;
   e) means for detonating said explosive sheet means and for explosively rupturing said diaphragm members;
   f) liquid fuel filling a cavity in said container means defined between said inner containment means and said outer wall; and
   g) chemical initiator means compatible with said liquid fuel and contained within said inner containment means;
   h) whereby detonation of said sheet means will accelerate said fuel outwardly, rupturing said outer wall, so that a cloud of fuel droplets-in-air will be created outwardly of said container means, and explosive rupturing of said diaphragm members will allow said initiator means to jet under pressure from said inner containment means through the ruptured diaphragm members in a turbulent manner, said initiator means reacting chemically with said fuel-in-air cloud to detonate said cloud.

7. The component of claim 6 wherein said container means comprises an elongated cylinder having non-rupturable end walls and said inner containment means comprises an annular cylinder extending axially of said elongated cylinder between said end walls.

8. The component of claim 7 wherein said openings are distributed along the length and about the periphery of said annular cylinder.

9. The component of claim 8 wherein each of said diaphragm members comprises a metallic diaphragm sealing the opening and carrying an explosive disc centrally thereof.

10. The component of claim 6, wherein said liquid fuel is selected from the groups consisting of butane, propylene oxide, propane, hexyl nitrate, ethyl hexyl nitrate, 1-hexene and acetylene dissolved in acetone, and said initiator means is a mixture of a halogen gas and a gaseous diluent.

11. The component of claim 10, wherein said gaseous diluent is air.

12. The component of claim 6, wherein said liquid fuel is selected from the group consisting of butane, propylene oxide, propane, hexyl nitrate, ethyl hexyl nitrate, 1-hexene and acetylene dissolved in acetone, and the initiator means is a combustible gaseous mixture.

13. The component of claim 12, wherein said combustible gaseous mixture includes hydrogen and oxygen.

* * * * *

UNITED STATES PATENT AND TRADEMARK OFFICE
CERTIFICATE OF CORRECTION

PATENT NO. : 5,168,123

DATED : December 1, 1992

INVENTOR(S) : Stephen B. MURRAY et al

It is certified that error appears in the above-identified patent and that said Letters Patent is hereby corrected as shown below:

Title page, left-hand column, change:

"[75] Inventor: John H. Lee, Montreal, Canada" to;

--[75] Inventor: Stephen B. Murray, Medicine Hat, Canada;
Ingar O. Moen, Medicine Hat, Canada;
Romuald Knystautas, Prevost, Canada; and
John H. Lee, Montreal, Canada--.

Signed and Sealed this

Ninth Day of November, 1993

Bruce Lehman

*Attest:*

BRUCE LEHMAN

*Attesting Officer*

*Commissioner of Patents and Trademarks*